US008792813B2

(12) United States Patent
Ichizawa

(10) Patent No.: US 8,792,813 B2
(45) Date of Patent: Jul. 29, 2014

(54) TRANSFER ROLL AND IMAGE FORMING APPARATUS

(75) Inventor: Nobuyuki Ichizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 200 days.

(21) Appl. No.: 13/401,114

(22) Filed: Feb. 21, 2012

(65) Prior Publication Data

US 2013/0034373 A1 Feb. 7, 2013

(30) Foreign Application Priority Data

Aug. 4, 2011 (JP) ..... 2011-171275

(51) Int. Cl.
*G03G 15/16* (2006.01)

(52) U.S. Cl.
USPC ..... 399/313; 428/217

(58) Field of Classification Search
None
See application file for complete search history.

(56) References Cited

U.S. PATENT DOCUMENTS 6,293,895 B1 * 9/2001 Koyama et al. ..... 492/56
2011/0194880 A1 * 8/2011 Ogawa et al. ..... 399/313

FOREIGN PATENT DOCUMENTS

JP 06083217 A * 3/1994 ..... G03G 15/16
JP A-2000-275930 10/2000
JP A-2006-350075 12/2006

* cited by examiner

*Primary Examiner* — Clayton E Laballe
*Assistant Examiner* — Jas Sanghera
(74) *Attorney, Agent, or Firm* — Oliff PLC

(57) ABSTRACT

A transfer roll includes a cylindrical conductive substrate; an inner elastic layer having an Asker-C hardness of from 5° to 20°; and an outer elastic layer having an Asker-C hardness of from 30° to 45° in this order, wherein the transfer roll satisfies the following Expression (1):

$\rho^{0}(in)>\rho^{0}(out)$ Expression (1):

wherein $\rho^{0}(in)$ is a volume resistivity of the inner elastic layer that is measured by applying an applied voltage of 1000 V in an environment of a temperature of 22° C. and a humidity of 55 RH % in an unloaded state, and $\rho^{0}(out)$ is a volume resistivity of the outer elastic layer that is measured by applying an applied voltage of 1000 V in an environment of a temperature of 22° C. and a humidity of 55 RH % in an unloaded state.

16 Claims, 5 Drawing Sheets

TRANSFER ROLL AND IMAGE FORMING APPARATUS

CROSS-REFERENCE TO RELATED APPLICATIONS

This application is based on and claims priority under 35 USC 119 from Japanese Patent Application No. 2011-171275 filed Aug. 4, 2011.

BACKGROUND

1. Technical Field

The present invention relates to a transfer roll and an image forming apparatus.

2. Related Art

In an image forming apparatus of an intermediate transfer system using an electrophotographic system, charges are formed on the surface of an image holding member, such as a photoreceptor, using a charging device, and an electrostatic latent image is formed with a laser beam or the like obtained by modulating an image signal. Then, a toner image that is made visible by developing the electrostatic latent image with a charged toner is formed. The toner image is electrostatically transferred to a recording medium, such as recording paper, via an intermediate transfer medium, and fixed onto the recording medium so as to obtain an image.

SUMMARY

According to an aspect of the invention, there is provided a transfer roll including: a cylindrical conductive substrate; an inner elastic layer having an Asker-C hardness of from 5° to 20°; and an outer elastic layer having an Asker-C hardness of from 30° to 45° in this order, wherein the transfer roll satisfies the following Expression (1):

$$\rho^0(\text{in})>\rho^0(\text{out}) \qquad \text{Expression (1):}$$

wherein $\rho^0(\text{in})$ is a volume resistivity of the inner elastic layer that is measured by applying an applied voltage of 1000 V in an environment of a temperature of 22° C. and a humidity of 55 RH % in an unloaded state, and $\rho^0(\text{out})$ is a volume resistivity of the outer elastic layer that is measured by applying an applied voltage of 1000 V in an environment of a temperature of 22° C. and a humidity of 55 RH % in an unloaded state.

BRIEF DESCRIPTION OF THE DRAWINGS

Exemplary embodiments of the present invention will be described in detail based on the following figures, wherein.

DETAILED DESCRIPTION

An exemplary embodiment of a transfer roll and an image forming apparatus of an aspect of the invention will be described below in detail.

(Transfer Roll)

A transfer roll related to the present exemplary embodiment has a cylindrical conductive substrate, an inner elastic layer (hereinafter simply referred to as an "inner layer") containing a conductive material, and having an Asker-C hardness of from 5° to 20°, and an outer elastic layer (hereinafter simply referred to as an "outer layer") containing a conductive material and having an Asker-C hardness of from 30° to 45° in this order. The volume resistivity [$\rho^0(\text{in})$] of the inner layer and the volume resistivity [$\rho^0(\text{out})$] of the outer layer that are measured by applying an applied voltage of 1000 V in an environment of a temperature of 22° C. and a humidity of 55 RH % in a state where no load is applied satisfy the following Expression (1)

$$\rho^0(\text{in})>\rho^0(\text{out}) \qquad \text{Expression (1):}$$

(Hereinafter, this transfer roll is referred to as the "transfer roll related to the first exemplary embodiment".)

A transfer roll to be used for an image forming apparatus is arranged to face the other conductive roll, and is used in a state where load is applied from the other roll and a nip (region where the transfer roll is pushed and crushed by the load from the other roll) is formed. If an applied voltage is applied in a state like this the nip is formed, an electric current flows from the transfer roll toward the other roll or from the other roll toward the transfer roll at this nip portion. However, at that time, discharging or current leakage may occur even in regions (region where the transfer roll is not pushed and crushed by the loads from the other roll) other than the nip.

When the transfer roll is applied to an image forming apparatus, occurrence of the discharging or the current leakage leads to scattering of toner when the toner is transferred, and leads to occurrence of image defect (scattering or blurring of the toner) in an image that is formed as a result.

Figure 1:
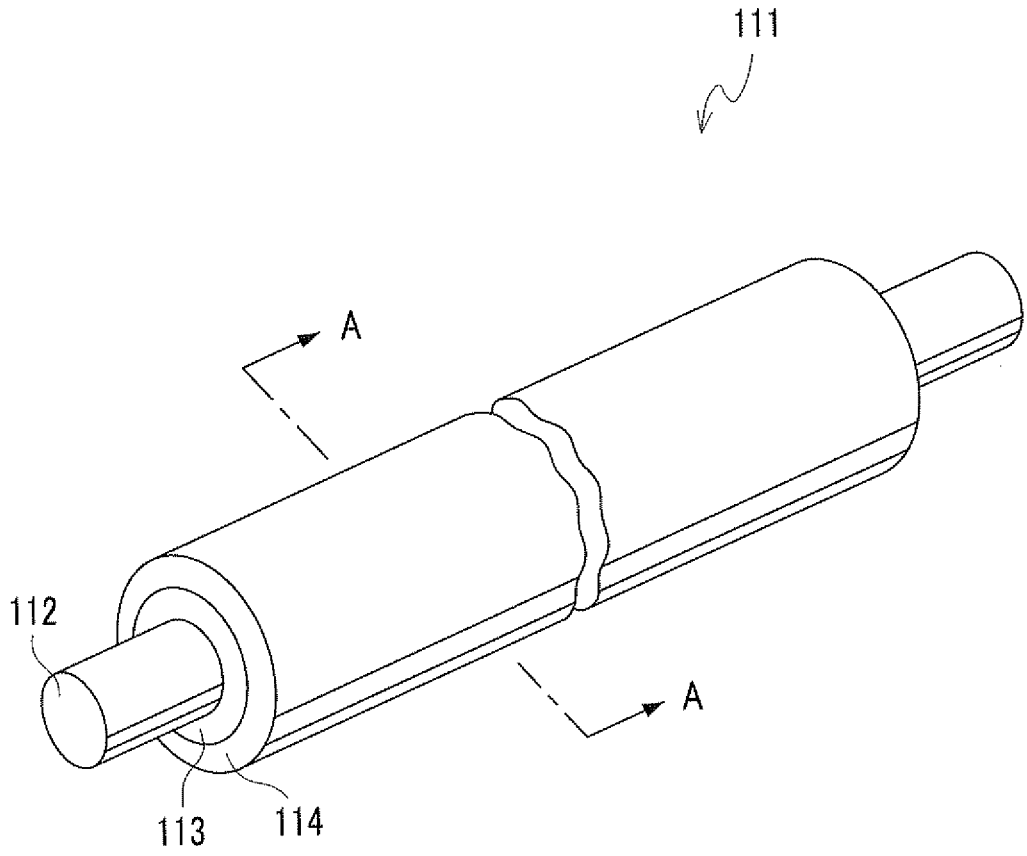
FIG. 1 is a schematic perspective view showing a transfer roll related to the present exemplary embodiment.
Figure 2:
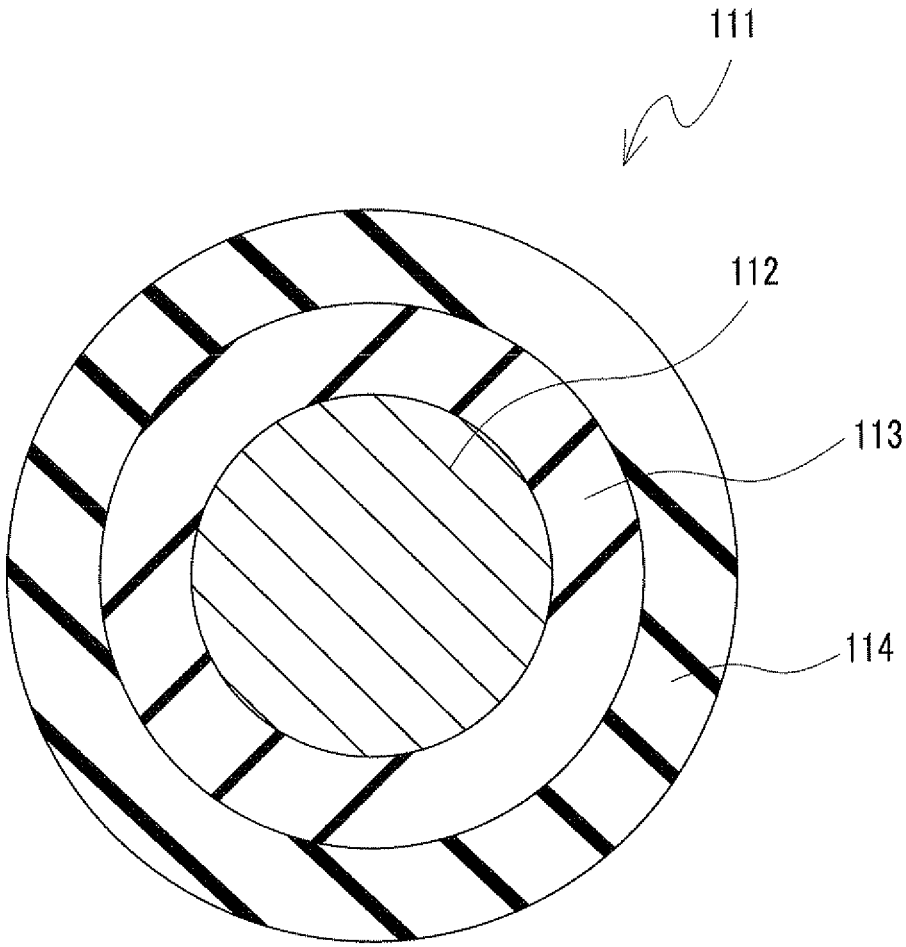
FIG. 2 is a schematic cross-sectional view of the transfer roll related to the present exemplary embodiment.
Figure 3:
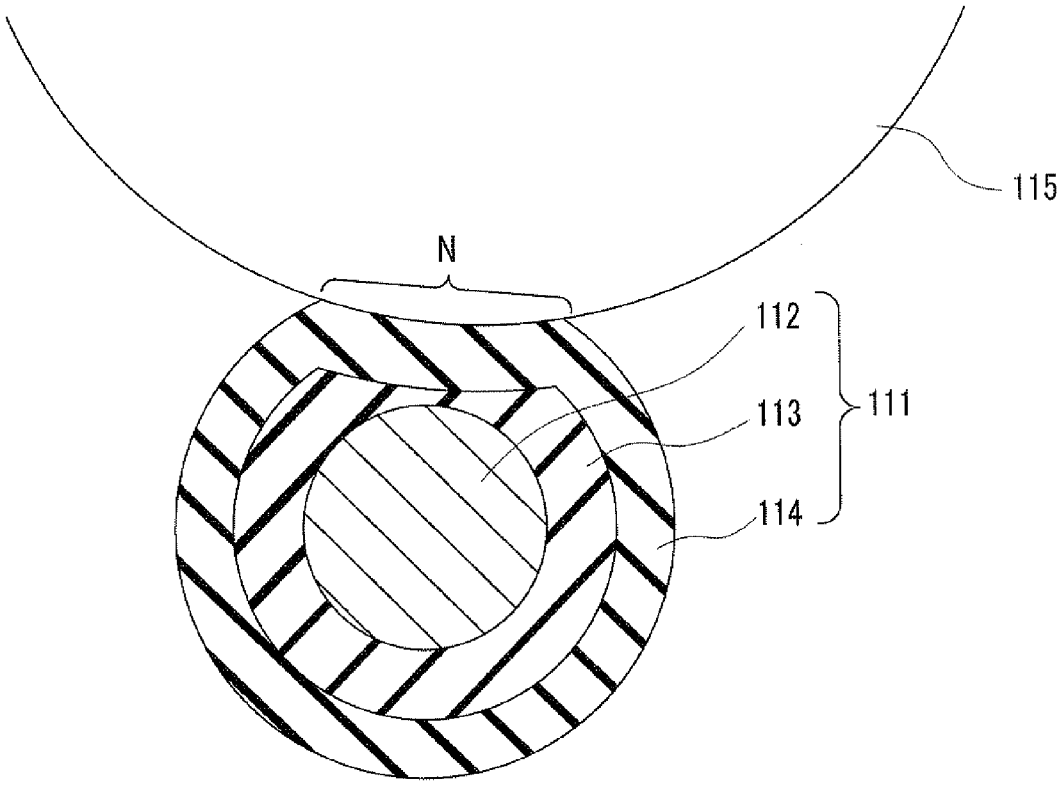
FIG. 3 is a schematic cross-sectional view showing a state where the transfer roll related to the present exemplary embodiment forms a nip with another roll.

In contrast, as shown in FIGS. 1 and 2, a transfer roll 111 related to the above first exemplary embodiment has an inner layer 113 and an outer layer 114 on the outer peripheral surface of a conductive substrate 112, and has a configuration in which the volume resistivity in a state (with no load) where no load is applied is "Inner layer>Outer layer" and the Asker-C hardness is "Inner layer<Outer layer". As shown in FIG. 3, when the transfer roll 111 related to the present exemplary embodiment forms the nip N as load is applied thereto from the other roll 115, the inner layer 113 of which Asker-C hardness is with a lower range shrinks, and the thickness thereof becomes small, and the inner layer 113 plays a role of a dent of the nip N portion. At this time, in the inner layer 113, the resistance of the nip N portion of which thickness shrinks becomes low due to the electric field dependability of resistance peculiar to electron conductivity. In addition, in the transfer roll 111 related to the present exemplary embodiment, the volume resistivity with no load is "Inner layer>Outer layer" as described above. Therefore, the resistance of the inner layer 113 also contributes to the resistance (that is, the resistance of a region from the conductive substrate 112 to the outer peripheral surface of the transfer roll 111) of all the inner and outer layers in the transfer roll 111 with no load. Therefore, the resistance of all the inner and outer layers in the transfer roll becomes the relationship of "Nip N region<Regions other than the nip N". Thereby, in the nip N region where the thickness of the inner layer 113 shrinks and the resistance becomes low, an electric current flows favorably between the conductive substrate 112 and the outer peripheral surface of the transfer roll 111, and in regions other than the nip N to which no load is applied, it is inferred that the flow of the electric current between the conductive substrate 112 and the outer peripheral surface of the transfer roll 111 is suppressed, and the flow of the electric current concentrates on the nip N.

As a result, it is inferred that occurrence of discharging or current leakage in regions other than the nip N region formed by the transfer roll 111 and the other roll 115 is efficiently suppressed. In a case where the transfer roll 111 is applied to an image forming apparatus, it is inferred that scattering of toner when the toner is transferred is suppressed, and image defect (scattering or blurring of the toner) in an image is suppressed.

In addition, in the transfer roll 111 related to the present exemplary embodiment, the volume resistivity [$\rho^{\alpha}$(in)] of the inner layer 113 and the volume resistivity [$\rho^{\alpha}$(out)] of the outer layer 114 that are measured by applying an applied voltage of 1000 V in an environment of a temperature of 22° C. and a humidity of 55 RH % in a state where load is applied from above the outer layer 114 so that the thickness of the inner layer 113 may become at least any thickness of from 20% to 30% of the thickness when no load is applied preferably satisfy the following Expression (2).

$$\rho^{\alpha}(\text{in})<\rho^{\alpha}(\text{out}) \qquad \text{Expression (2):}$$

(Hereinafter, this transfer roll is referred to as the "transfer roll related to the second exemplary embodiment".)

When the transfer roll 111 related to the above second exemplary embodiment and the other roll 115 form the nip N, the height of the resistance becomes the relationship of "Inner layer<Outer layer" in a portion where the thickness of the inner layer 113 of the transfer roll 111 shrinks and the resistance become low (that is, reversed from the relationship of both the layers in regions other than the nip N). Thereby, in regions (that is, regions other than the nip N) to which the load of the transfer roll 111 is not applied, the resistance of the inner layer 113 contributes to the resistance of all the inner and outer layers in the transfer roll 111. On the other hand, in the region (that is, the nip N region) to which the load of the transfer roll 111 is applied, the resistance of the outer layer 114 contributes to the resistance of all the inner and outer layers in the transfer roll 111.

Therefore, the resistance of all the inner and outer layers in the transfer roll becomes the relationship of "Nip N region<Regions other than the nip N". Thereby, in the nip N region where the thickness of the inner layer 113 shrinks and the resistance becomes low, an electric current flows more favorably between the conductive substrate 112 and the outer peripheral surface of the transfer roll 111, and in regions other than the nip N to which no load is applied, it is inferred that the flow of the electric current between the conductive substrate 112 and the outer peripheral surface of the transfer roll 111 is suppressed, and the flow of the electric current further concentrates on the nip N.

As a result, it is inferred that occurrence of discharging or current leakage in regions other than the nip N region formed by the transfer roll 111 and the other roll 115 is efficiently suppressed. In a case where the transfer roll 111 is applied to an image forming apparatus, it is inferred that scattering of toner when the toner is transferred is suppressed, and image defect (scattering or blurring of the toner) in an image is suppressed.

Additionally, it is more preferable that the conductive material to be contained in the inner layer 113 be a conductive material (hereinafter simply referred to as an "electron conductive material") with electron conductivity, and the conductive material to be contained in the outer layer 114 be a conductive material (hereinafter simply referred to as an "ion conductive material") with ion conductivity.

In the ion conductive material, compared to the electron conductive material, unevenness of resistance or resistance fluctuation does not easily occur, and as the ion conductive material is contained in the outer layer 114, unevenness of resistance or resistance fluctuation is efficiently suppressed.

Additionally, in particular, in the transfer roll related to the second exemplary embodiment in which the resistance of the outer layer 114 contributes to the resistance of all the inner and outer layer in the nip N region of the transfer roll 111, it is inferred that the electron conductive material is contained in the inner layer 113 and the ion conductive material is contained in the outer layer 114, whereby unevenness of resistance or resistance fluctuation in the nip N region through which an electric current flows in a concentrated manner is efficiently suppressed, and an electric current flows stably in the nip N region.

In addition, the "conductivity" in respective constituent elements of the transfer roll related to the present exemplary embodiment means that the volume resistivity at 20° C. is equal to or less than $1\times10^{9}$ Ω·cm.

—Method of Measuring Asker-C Hardness—

First, targeted inner layer 113 and outer layer 114 are peeled off from the transfer roll 111, respectively, and a measurement sample (thickness of 3 mm) of the inner layer and a measurement sample (thickness 10 mm) of the outer layer are prepared, respectively. A measurement needle of the Asker-C-type hardness meter (made by Kobunshi Keiki Co., Ltd.) is pressed against the surface of each measurement sample, and measurement is made on the condition of a load of 1000 g.

—Method of Measuring Volume Resistivity—

The inner layer 113 and the outer layer 114 are individually prepared in the shape of a tube, respectively, and the individual inner layer and outer layer are coated on a shaft so as to obtain samples for measurement of resistance that are individually formed.

Figure 4:
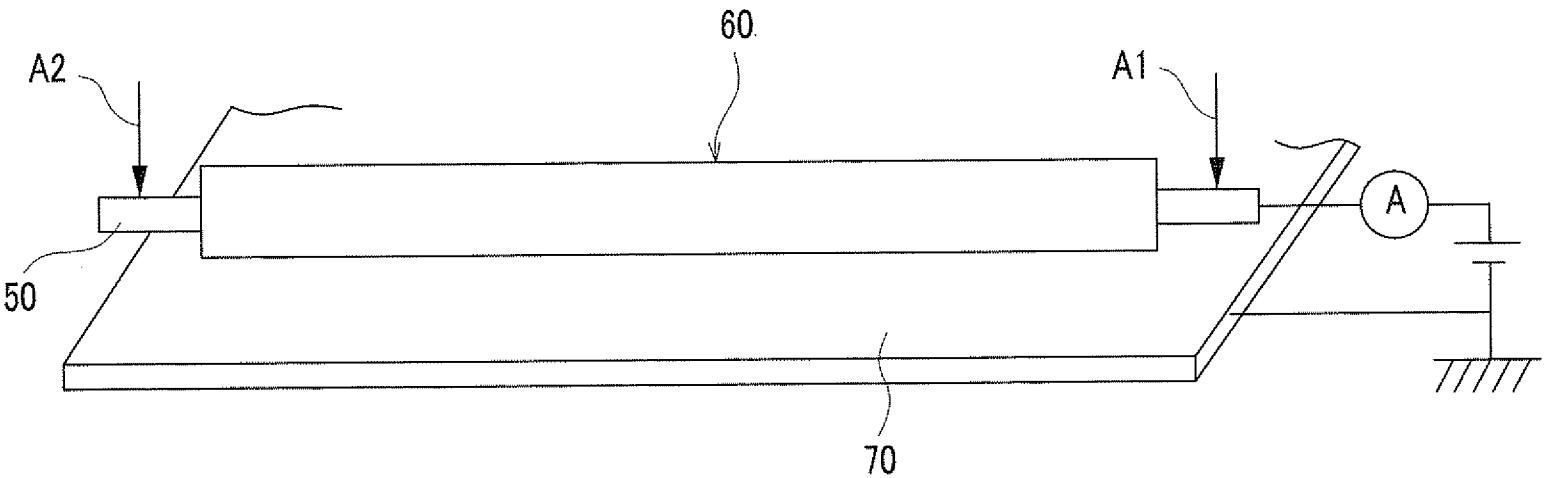
FIG. 4 is a schematic view for describing a method for measuring volume resistivity.

The "volume resistivity [$\rho^{0}$(in)] of the inner layer in a state where no load is applied" and the "volume resistivity [$\rho^{0}$(out)] of the outer layer in a state where no load is applied" are calculated according to the following Expression after a sample 60 for measurement of resistance is placed on a metal plate 70 as shown in FIG. 4, an applied voltage V of 1000 V is applied to between a core bar 50 and the metal plate 70 in an environment of a temperature of 22° C. and a humidity of 55 RH %, and a current value I(A) is read after 10 seconds.

$$R-V/I \qquad \text{Expression:}$$

Additionally, the "volume resistivity [$\rho^{\alpha}$(in)] of the inner layer in a state where load is applied from above the outer elastic layer so that the thickness of the inner layer may become at least any thickness of from 20% to 30% of the thickness when no load is applied is calculated according to the above Expression after the sample 60 for measurement of resistance is placed on the metal plate 70 as shown in FIG. 4, an applied voltage V of 1000 V is applied to between the core bar 50 and the metal plate 70 in an environment of a temperature of 22° C. and a humidity of 55 RH % in a state where load is applied to two spots indicated by arrows A1 and A2 at both ends of the core bar 50 so that the thickness of the measurement sample may become at least any thickness of from 20% to 30% of the thickness when no load is applied, and a current value I(A) is read after 10 seconds.

Additionally, the "volume resistivity [$\rho^{\alpha}$(out)] of the outer layer in a state where load is applied from above the outer elastic layer so that the thickness of the inner layer may become the thickness of 30% when no load is applied is calculated using the measurement values of the aforementioned "volume resistivity [$\rho^0$(out)] of the outer layer in a state where no load is applied" because the inner layer 113 plays a role of a dent of the nip N portion as already described.

Moreover, the volume resistivity (that is, the resistivity of the region from the conductive substrate 112 to the outer peripheral surface of the transfer roll 111) of all the inner and outer layers in the transfer roll 111 is measured by replacing the sample 60 for measurement of resistance in FIG. 4 with the transfer roll 111.

In addition, the measurement of the volume resistivity is performed at four circumferential points by shifting the sample 60 for measurement of resistance by every 90° to obtain the average value thereof.

—Method of Achievement—

In addition, the requirements for Expression (1) and the requirements for Expression (2) are achieved by adjusting the balance between the type of the conductive material and the amount of the conductive material to be used for the inner layer 113 and the outer layer 114. Additionally, the Asker-C hardness in the inner layer 113 and the outer layer 114 is adjusted by selecting constituent materials, such as elastic materials to be used for the inner layer 113 and the outer layer 114, respectively.

The respective constituent elements of the transfer roll 111 related to the present exemplary embodiment will be described below in detail.

(Conductive Substrate)

The conductive substrate 112 will be described.

The conductive substrate 112 is a member that functions as an electrode of a roll member and a supporting member. Examples of the conductive substrate 112 include members made of metals, such as iron (free-cutting steel or the like), copper, brass, stainless steel, aluminum, and nickel.

Examples of the conductive substrate 112 include a member (for example, resin or ceramic member) of which the outer surface is subjected to plating treatment, a member (for example, resin or ceramic member) having the conductive material dispersed therein, and the like.

The conductive substrate 112 may be a hollow member (tubular member), and may be a non-hollow member.

(Inner Elastic Layer (Inner Layer))

The configuration of the inner layer 113 will be described.

The inner layer 113 is configured so as to include, for example, a rubber material (elastic material), a conductive material, and if needed, other additives.

Examples of the rubber material (elastic material) include a so-called elastic material having at least a double bond in a chemical structure.

Specifically, examples of the rubber material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allylglycidylether copolymer rubber, ethylene-propylene-diene ternary copolymer rubber (EPDM), acrylonitrile-butadiene copolymer rubber (NBR), natural rubber, and the like, and rubbers obtained by mixing the above rubbers.

Among these rubber materials, examples of the rubber material suitably include polyurethane, EPDM, epichlorohydrin-ethylene oxide copolymer rubber, epichlorohydrin-ethylene oxide-allylglycidylether copolymer rubber, NBR, and rubbers obtained mixing these rubbers.

The conductive material includes the conductive material (ion conductive material) with ion conductivity and the conductive material (electron conductive material) with electron conductivity.

Examples of the ion conductive materials include quaternary ammonium salts (for example, lauryl trimethyl ammonium, stearyl trimethyl ammonium, octadodecyl trimethyl ammonium, dodecyl trimethyl ammonium, hexadecyl trimethyl ammonium, perchloric acid salt, chlorine acid salt, fluoroboric acid salt, sulfate salt, ethosulfate salt, benzyl halide salt (benzyl bromide salt, benzyl chloride salt and the like) and the like of modified fatty acid dimethyl ethyl ammonium, and the like), aliphatic sulfonic acid salt, higher alcohol sulfuric acid ester salt, higher alcohol ethylene oxide adduct sulfuric acid ester salt, higher alcohol phosphoric acid ester salt, higher alcohol ethylene oxide adduct phosphoric acid ester salt, various betaines, higher alcohol ethylene oxide, polyethylene glycol fatty acid ester, and polyhydric alcohol fatty acid ester.

The ion conductive materials may be used independently, or used in combinations of two or more thereof.

The content of the ion conductive materials may be, for example, within a range of 0.1 part by mass or more and 5.0 parts by mass or less to 100 parts by mass of the rubber material, and preferably, 0.5 part by mass or more and 3.0 parts by mass or less.

Examples the electron conductive material include powders, for example, carbon blacks such as ketjen black and acetylene black; pyrolytic carbon, graphite; various conductive metals or alloys such as aluminum, copper, nickel and stainless steel; various conductive metal oxides such as tin oxide, indium oxide, titanium oxide, a solid solution of tin oxide-antimony oxide and a solid solution of tin oxide-indium oxide; and those of which the surface made of the insulating substance is treated to become conductive.

Here, specific examples of the carbon blacks include "Special black 350", "Special black 100", "Special black 250", "Special black 5", "Special black 4", "Special black 4A", "Special black 550", "Special black 6", "Color black FW200", "Color black FW2", and "Color black FW2V", all of which are made by Degussa AG; "MONARCH1000", MONARCH1300", "MONARCH1400", "MOGUL-L", and "REGAL400R", all of which are by Cabot Corp.; and the like.

The electron conductive materials may be used independently, or used in combinations of two or more thereof.

The content of the electron conductive materials may be, for example, within a range of 1 part by mass or more and 30 parts by mass or less to 100 parts by mass of the rubber material, and preferably, 15 parts by mass or more and 25 parts by mass or less.

Examples of the other additives include materials that may be normally added to an elastic layer, such as a foaming agent, a foaming assistant, a softener, a plasticizer, a curing agent, a vulcanizing agent, a vulcanizing accelerator, an antioxidant, a surfactant, a coupling agent, and filler materials (silica, calcium carbonate, and the like).

Particularly, it is preferable that the inner layer 113 be made to contain a foaming agent so as to form an elastic layer having bubbles.

The average bubble diameter (cell diameter) of the inner layer 113 may be smaller than the average bubble diameter (cell diameter) of the outer layer 114.

The average bubble diameter of the inner layer 113 may be, for example, from 100 μm to 300 μm.

The foaming rate (expansion rate) of the inner layer 113 may be, for example, from 150% to 400%.

Here, the average bubble diameter is an average value measured using a digital microscope (VHX900 made by Keyence Corp.) and performing this measurement on twenty cells.

On the other hand, the foaming rate (expansion rate) is calculated from the specific gravity of a sample after which is measured using a digital hydrometer (trade name "AND-DMA-220" made by Ando Keiki Co. Ltd.).

The bubbles (cells) of the inner layer 113 may be in a state (so-called independent bubbles) where adjacent bubbles (cells) are independent or may be in a continuous state (so-called continuous bubbles) where adjacent bubbles are continuous.

The thickness of the inner layer 113 may be, for example, from 1 mm to 10 mm, and preferably from 2 mm to 5 mm.

(Outer Elastic Layer (Outer Layer))

The configuration of the outer layer 114 will be described.

The outer layer 114 is configured so as to include, for example, a rubber material (elastic material), a conductive material, and if needed, other additives.

The rubber material (elastic material), the conductive material, and other additives include those described in the inner layer 113. In addition, it is more preferable to use the ion conductive material for the conductive material of the outer layer 114 and to use the electron conductive material for the conductive material of the inner layer 113.

Particularly, it is preferable that the outer layer 114 be made to contain a foaming agent so as to form an elastic layer having air bubbles.

The average bubble diameter (cell diameter) of the outer layer 114 may be larger than the average bubble diameter (cell diameter) of the inner layer 113.

The average bubble diameter of the outer layer 114 may be, for example, from 150 μm to 400 μm.

The foaming rate (expansion rate) of the outer layer 114 may be, for example, from 150% to 400%.

Here, the methods of measuring the average bubble diameter and the foaming rate (expansion rate) are the same as those of the inner layer 113.

The bubbles (cells) of the outer layer 114 may be in a state (so-called independent bubbles) where adjacent bubbles (cells) are independent or may be in a continuous state (so-called continuous bubbles) where adjacent bubbles are continuous.

The thickness of the outer layer 114 may be, for example, from 1 mm to 10 mm, and preferably from 2 mm to 5 mm.

The transfer roll 111 related to the present exemplary embodiment described above is suitably used as a primary transfer roll arranged to face an image holding member (photoreceptor), a secondary transfer roll that transfers a toner image held on an intermediate transfer belt to a recording medium, a facing roll arranged to face this secondary transfer roll, or the like, for example, in an image forming apparatus.

[Image Forming Apparatus and Process Cartridge]

An image forming apparatus related to the present exemplary embodiment includes an image holding member, a latent image forming device that forms an electrostatic latent image on the surface of the image holding member, a developing device that develops the electrostatic latent image with a toner to form a toner image, an intermediate transfer belt, a primary transfer device that transfers the toner image on the image holding member to the intermediate transfer belt, and a secondary transfer device that transfers the toner image transferred to the intermediate transfer belt to a recording medium. The transfer roll related to the aforementioned present exemplary embodiment is used as a primary transfer roll in the primary transfer device, a secondary transfer roll in the secondary transfer device, or a facing roll in the secondary transfer device.

When the transfer roll related to the present exemplary embodiment is used as the primary transfer roll, specifically, the primary transfer roll is arranged so as to face the image holding member via the intermediate transfer belt and form a nip by the load applied from the image holding member, and applies a voltage for transferring the toner image on the image holding member to the surface of the intermediate transfer belt.

In addition, in the primary transfer roll, it is more preferable to use a transfer roll that satisfies the above Expression (2). In that case, a load and an applied voltage that the volume resistivity $[\rho^{\beta-1}(in)]$ of the inner elastic layer and the volume resistivity $[\rho^{\beta-1}(out)]$ of the outer elastic layer in a state where the nip is formed satisfy the following Expression (3-1) are preferably applied to the primary transfer roll in a portion where the nip is formed.

$$\rho^{\beta-1}(in)<\rho^{\beta-1}(out) \qquad \text{Expression (3-1):}$$

When the transfer roll related to the present exemplary embodiment is used as the facing roll, specifically, the secondary transfer device includes a secondary transfer roll contacting the outer peripheral surface side of the intermediate transfer belt and having a recording medium inserted between the secondary transfer roll and the intermediate transfer belt, and a facing roll arranged so as to face the secondary transfer roll via the intermediate transfer belt and form a nip by the load applied from the secondary transfer roll, and applies a voltage for transferring the toner image on the intermediate transfer belt to a recording medium.

In addition, in the facing roll, it is more preferable to use a transfer roll that satisfies the above Expression (2). In that case, a load and an applied voltage that the volume resistivity $[\rho^{\beta-2}(in)]$ of the inner elastic layer and the volume resistivity $[\rho^{\beta-2}(out)]$ of the outer elastic layer in a state where the nip is formed satisfy the following Expression (3-2) are preferably applied to the facing roll in a portion where the nip is formed.

$$\rho^{\beta-2}(in)<\rho^{\beta-2}(out) \qquad \text{Expression (3-2):}$$

When the transfer roll related to the present exemplary embodiment is used as secondary transfer roll, specifically, the secondary transfer device includes a secondary transfer roll contacting the outer peripheral surface side of the intermediate transfer belt and having a recording medium inserted between the secondary transfer roll and the intermediate transfer belt, and a facing roll arranged so as to face the secondary transfer roll via the intermediate transfer belt and form a nip at the secondary transfer roll by applying the load to the secondary transfer roll, and applies a voltage for transferring the toner image on the intermediate transfer belt to a recording medium.

In addition, in the second transfer roll, it is more preferable to use a transfer roll that satisfies the above Expression (2). In that case, a load and an applied voltage that the volume resistivity $[\rho^{\beta-3}(in)]$ of the inner elastic layer and the volume resistivity $[\rho^{\beta-3}(out)]$ of the outer elastic layer in a state where the nip is formed satisfy the following Expression (3-3) are preferably applied to the secondary transfer roll in a portion where the nip is formed.

$$\rho^{\beta-3}(in)<\rho^{\beta-3}(out) \qquad \text{Expression (3-3):}$$

In addition, the volume resistivity $[\rho^{\beta-1}(in)]$ of the inner elastic layer and volume resistivity $[\rho^{\beta-1}(out)]$ of the outer elastic layer, the volume resistivity $[\rho^{\beta-2}(in)]$ of the inner elastic layer and the volume resistivity $[\rho^{\beta-3}(out)]$ of the outer elastic layer, and the volume resistivity $[\rho^{\beta-3}(in)]$ of the inner elastic layer and the volume resistivity $[\rho^{\beta-3}(out)]$ of the outer elastic layer in the state where the nip is formed are measured according to the aforementioned measuring method except for changing the values of the load and the applied voltage to values in the nip.

The image forming apparatus related to the present exemplary embodiment may be, for example, any one of a normal monochrome image forming apparatus that stores only a monochromatic toner within a developing device, a color image forming apparatus that repeats sequential primary transfer of toner images held on the image holding member to an intermediate transfer medium, and a tandem color image forming apparatus that has plural image holding members including developing devices for respective colors arranged in series on an intermediate transfer medium.

On the other hand, the process cartridge related to the present exemplary embodiment is attached to and detached from, for example, the image forming apparatus of the above configuration, and includes at least the transfer roll related to the above present exemplary embodiment.

Figure 5:
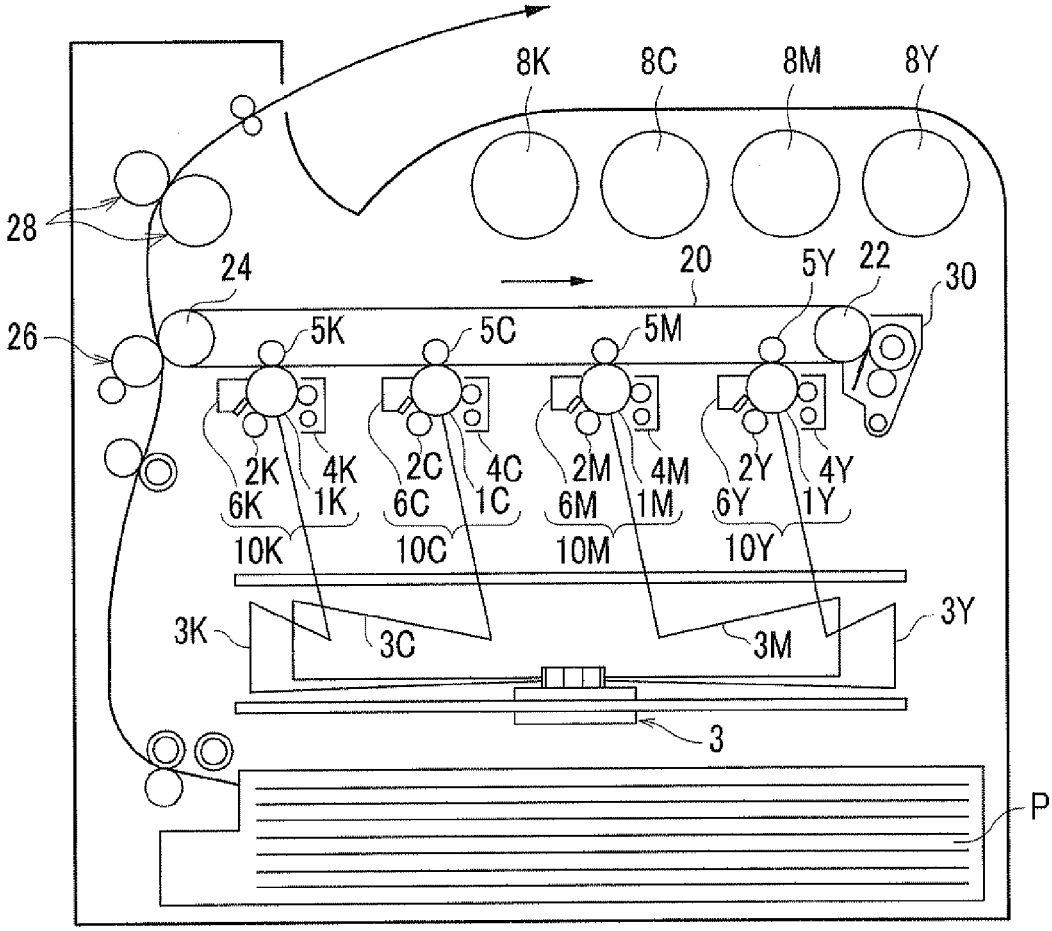
FIG. 5 is a schematic configuration view showing an image forming apparatus related to the present exemplary embodiment.

The image forming apparatus related to the present exemplary embodiment will be described below, referring to the drawings. FIG. 5 is a schematic configuration view showing the image forming apparatus related to the present exemplary embodiment.

An image forming apparatus shown in FIG. 5 includes a first to fourth image forming units 10Y, 10M, 10C, and 10K (image forming devices) of an electrophotographic system that outputs images in respective colors of yellow (Y), magenta (M), cyan (C), and black (K) based on image data of which color is separated. The image forming units (hereinafter simply referred to as "units") 10Y, 10M, 10C, and 10K are arranged in parallel so as to be horizontally separated at specific distances from each other. In addition, the units 10Y, 10M, 10C, and 10K may be process cartridges that may be attached to and detached from an image forming apparatus body.

Above the respective units 10Y, 10M, 10C, and 10K in the drawing, an intermediate transfer belt 20 as an intermediate transfer medium extends through the respective units. The intermediate transfer belt 20 is provided so as to be wound around a driving roll 22 and a facing roll 24 in contact with the inner surface of the intermediate transfer belt 20, which are arranged so as to be separated from each other in the right direction from the left direction in the drawing, and constitutes a transfer unit for the image forming apparatus so as to travel in a direction turned to the fourth unit 10K from the first unit 10Y.

In addition, the facing roll 24 is urged in a direction apart from the driving roll 22 by a spring (not shown) or the like, and a specific tension is given to the intermediate transfer belt 20 wound around both the rolls. Additionally, an intermediate transfer medium cleaning device 30 is provided at an image holding member lateral face of the intermediate transfer belt 20 so as to face the driving roll 22.

Additionally, developing devices (developing units) 4Y, 4M, 4C, and 4K of the respective units 10Y, 10M, 10C, and 10K may be respectively supplied with toners in four colors of yellow, magenta, cyan, and black that are stored in toner cartridges 8Y, 8M, 8C, and 8K.

Since the above-described first to fourth units 10Y, 10M, 10C, and 10K have the same configuration, the first unit 10Y that is disposed on the upstream side in the traveling direction of the intermediate transfer belt forms a yellow image will be representatively described. In addition, the description of the second to fourth units 10M, 10C, and 10K will be omitted by giving reference numerals with magenta (M), cyan (C), and black (K) instead of yellow (Y) to the same portions to the first unit 10Y.

The first unit 10Y has a photoreceptor 1Y that acts as an image holding member. A charging roller 2Y that charges the surface of the photoreceptor 1Y with specific potential, an exposure device 3 that exposes the charged surface with a laser-beam 3Y based on an image signal of which the colors are separated, to form an electrostatic latent image, the developing device (developing unit) 4Y that supplies a charged toner to the electrostatic latent image, to develop the electrostatic latent image, a primary transfer roll 5Y (primary transfer part) that transfers the developed toner image onto the intermediate transfer belt 20, a photoreceptor cleaning device (cleaning unit) 6Y that removes the toner remaining on the surface of the photoreceptor 1Y after the primary transfer with a cleaning blade are disposed in order around the photoreceptor 1Y.

In addition, the primary transfer roll 5Y is arranged inside the intermediate transfer belt 20, is provided at a position that faces the photoreceptor 1Y, and is arranged so as to form a nip by the load applied from the photoreceptor 1Y. Moreover, bias power sources (not shown) that apply primary transfer biases are connected to the respective primary transfer rolls 5Y, 5M, 5C, and 5K, respectively. The respective bias power sources make the transfer biases to be applied to the respective primary transfer rolls variable by the control using a control unit (not shown).

The operation of forming the yellow image in the first unit 10Y will be described. First, prior to the operation, the surface of the photoreceptor 1Y is charged with a potential of −600 V or more and −800 V or less by the charging roller 2Y.

The photoreceptor 1Y is formed by laminating a photosensitive layer on a conductive (volume resistivity at 20° C.: equal to or less than $1\times10^6$ Ω·cm) substrate. Although this photosensitive layer normally has high resistance (resistance similar to that of general resin), if the photosensitive layer is irradiated with the laser beam 3Y, the layer has a property that the specific resistance of a portion irradiated with the laser beam changes. Thus, the laser beam 3Y is output to the surface of the charged photoreceptor 1Y via the exposure device 3 according to the image data for yellow sent from the control unit (not shown). The laser beam 3Y is irradiated to the photosensitive layer on the surface of the photoreceptor 1Y, and thereby, an electrostatic latent image of a yellow printing pattern is formed on the surface of the photoreceptor 1Y.

The electrostatic latent image is an image formed on the surface of the photoreceptor 1Y by charging, and is a so-called negative latent image that is formed as the specific resistance of an irradiated portion of the photosensitive layer drops by the laser beam 3Y and the charged charges on the surface of the photoreceptor 1Y flow, while charges of a portion on which the laser beam 3Y is not irradiated remain.

The electrostatic latent image formed on the photoreceptor 1Y in this way is rotated to a specific development position according to the traveling of the photoreceptor 1Y. At this development position, the electrostatic latent image on the photoreceptor 1Y is turned into a visible image (development image) by the developing device 4Y.

A yellow toner, for example, is stored within the developing device 4Y. The yellow toner is frictionally charged by being agitated inside the developing device 4Y, and has charges with the same polarity (negative polarity) as electrostatic charges charged on the photoreceptor 1Y, and is thus held on a developer roll (developer holder). As the surface of the photoreceptor 1Y passes through the developing device 4Y, the yellow toner adheres electrostatically to a neutralized latent image portion on the surface of the photoreceptor 1Y, and the latent image is developed with the yellow toner. The photoreceptor 1Y on which the yellow toner image is formed is made to rotates at a specific speed succeedingly, and the toner image developed on the photoreceptor 1Y is transported to a specific primary transfer position.

If the yellow toner image on the photoreceptor 1Y is transported to the primary transfer position, a specific primary transfer bias is applied to the primary transfer roll 5Y, an electrostatic force turned to the primary transfer roll 5Y from the photoreceptor 1Y acts on the toner image, and the toner image on the photoreceptor 1Y is transferred onto the intermediate transfer belt 20. The transfer bias applied at this time has the (+) polarity opposite to the (−) polarity of toner. For example, in the first unit 10Y, the transfer bias is controlled to be about +10 μA by the control unit (not shown).

On the other hand, the toner remaining on the photoreceptor 1Y is removed and collected by the cleaning device 6Y.

Additionally, the primary transfer biases to be applied to the primary transfer rolls 5M, 5C, and 5K after the second unit 10M are also controlled according to the first unit.

The intermediate transfer belt 20 to which the yellow toner image is transferred in the first unit 10Y in this way is transported sequentially through the second to fourth units 10M, 10C, and 10K, and toner images in respective colors are superimposed and multi-transferred.

The intermediate transfer belt 20 to which the four color toner images are multi-transferred through the first to fourth units leads to a secondary transfer section constituted by intermediate transfer belt 20, the facing roll 24 in contact with the inner surface of the intermediate transfer belt 20, and the secondary transfer roll (secondary transfer part) 26 arranged on the side of the image holding surface of the intermediate transfer belt 20. In addition, the facing roll 24 is arranged so as to form a nip by the load applied from the secondary transfer roll 26. On the other hand, a recording medium P is fed to the gap where the secondary transfer roll 26 and the intermediate transfer belt 20 are in contact with each other via a feed mechanism at specific timing, and a specific secondary transfer bias is applied to the facing roll 24. The transfer bias to be applied at this time has (−) polarity having the same polarity as the (−) polarity of toner, an electrostatic force turned to the recording medium P from the intermediate transfer belt 20 acts on the toner image, and the toner image on the intermediate transfer belt 20 is transferred onto the recording medium P. In addition, the secondary transfer bias in this case is determined according to the resistance detected by a resistance detector (not shown) that detects the resistance of the secondary transfer section, and is controlled in voltage.

Thereafter, the recording medium P is sent to the fixing device (fixing unit) 28 where the toner image is heated, and the toner images of which colors are superimposed, fused, and are fixed onto the recording medium P. The recording medium P on which fixing of the color images is completed is carried out toward a discharge section, and a series of color image forming operations are ended.

In addition, although the above illustrated image forming apparatus has a configuration in which toner images are transferred to the recording medium P via the intermediate transfer belt 20, the invention is not limited to this configuration.

EXAMPLES

Although the invention will be described below in more detail on the basis of the examples, the invention is not limited to the following examples. In addition, "parts" means "parts by mass" as long as there is no particular mention.

<Method of Forming Inner Layer>

(Formation of Inner Layer-1)

100 parts of polyoxypropylenetriol (molecular weight 3000) is made to react with 25 parts of tolylene diisocyanate (TDI-80 made by Nippon Polyurethane Industries Co. Ltd.) so as to obtain a urethane prepolymer. 15 parts of carbon black (Special Black 4 A made by Degussa AG), and 1 part of N-methylmorpholine as a reaction activation catalyst, 0.3 parts of triethylamine, and 3 parts of a silicon-based surfactant (L-520 made by Nippon Unicar Company Limited) are added to 100 parts of the urethane prepolymer, are stirred, mixed and foamed for 30 seconds so as to obtain a foamed solution for the inner layer.

The foamed solution is poured into a mold into which a shaft having φ8 mm and made of SUS is put, and is thermally cured at 80° C. so as to form a foaming layer of urethane foam. Further, the surface of the foaming layer is ground and molded with a thickness of 10 mm (external diameter of 28 mm) so as to form an inner layer. The Asker-C hardness (1000 g load) is 15 degrees.

(Formation of Inner Layer-2)

The inner layer is formed by the same method except that that the parts by weight of the silicon-based surfactant (L-520 made by Nippon Unicar Company Limited) in Formation of Inner Layer-1 are changed to 7 parts. The Asker-C hardness (1000 g load) is 7 degrees.

(Formation of Inner Layer-3)

The inner layer is formed by the same method except that that the parts by weight of the silicon-based surfactant (L-520 made by Nippon Unicar Company Limited) in Formation of Inner Layer-1 are changed to 2 parts. The Asker-C hardness (1000 g load) is 20 degrees.

<Method of Forming Outer Layer>

(Formation of Outer Layer-1)

60 parts of epichlorohydrin rubber (ECO: Epichlomer CG-102 made by Daiso Co., Ltd.) with high ion conductivity containing an ethylene oxide group, and 30 parts of acrylonitrile butadiene rubber (NBR: Nipol DN-219 made by Nippon Zeon Co., Ltd.) are mixed together. Further, 1 part of sulfur (made by Tsurumi Chemical Industry Co. Ltd; 200 meshes), 1.5 parts of a vulcanizing accelerator (NOCCELLER-M made by Ouchi Shinko Chemical Industry Co. Ltd.), and 6 parts of benzene sulfonyl hydrazide as a foaming agent are added and kneaded in an open roll, so as to obtain a mixture. This mixture is wound around a shaft having φ28 mm and made of SUS, and the above shaft made of SUS is heated at 160° C. to vulcanize and foam the mixture to form a foaming layer. Further, the outer peripheral surface of the foaming layer is grounded so as to have an external diameter of 42 mm and a thickness of 7 mm, and is then drawn out from the shaft to form a foaming tube for an outer layer. The Asker-C hardness (1000 g load) is 40 degrees.

(Formation of Outer Layer-2)

The outer layer is formed by the same method except that that the parts by weight of the benzene sulfonyl hydrazide in Formation of Outer Layer-1 are changed to 10 parts. The Asker-C hardness (1000 g load) is 25 degrees.

(Formation of Outer Layer-3)

The outer layer is formed by the same method except that that the parts by weight of the benzene sulfonyl hydrazide in Formation of Outer Layer-1 are changed to 3 parts. The Asker-C hardness (1000 g load) is 48 degrees.

(Formation of Outer Layer-4)

The outer layer is formed by the same method except that that the parts by weight of the benzene sulfonyl hydrazide in Formation of Outer Layer-1 are changed to 8 parts. The Asker-C hardness (1000 g load) is 32 degrees.

(Formation of Outer Layer-5)

The outer layer is formed by the same method except that that the parts by weight of the benzene sulfonyl hydrazide in Formation of Outer Layer-1 are changed to 5 parts. The Asker-C hardness (1000 g load) is 43 degrees.

<Preparation of Transfer Roll>

The foaming tube for an outer layer is inserted into the shaft made of SUS forming the inner layer while blowing air, so as to obtain a transfer roll. In addition, the combinations of the inner layer and outer layer in the respective example and comparative examples are as in the following Table 1.

TABLE 1

| | Inner Layer | Outer Layer |
|---|---|---|
| Example 1 | 1 | 1 |
| Example 2 | 1 | 1 |
| Example 3 | 1 | 1 |
| Example 4 | 1 | 1 |
| Example 5 | 2 | 1 |
| Example 6 | 3 | 1 |
| Example 7 | 1 | 4 |
| Example 8 | 1 | 5 |
| Comparative Example 1 | 1 | 2 |
| Comparative Example 2 | 1 | 3 |

Example 1

(Measurement of Physical Property Values)

The volume resistivity of the inner layer [$\rho^0$(in)] in a state where no load is applied, the volume resistivity [$\rho^0$(out)] of the outer layer in a state where no load is applied, the volume resistivity [$\rho^\alpha$(in)] of the inner layer in a state where load is applied (state that load is applied so that the thickness of the inner layer may become 20% of the thickness in a state where no load is applied), and the volume resistivity (that is, specific resistance of the region from a shaft to the outer peripheral surface of a transfer roll) of all the inner and other layers in the transfer roll in a state where load is applied are measured by the aforementioned method on the measurement conditions of a temperature of 22° C., a humidity of 55 RH %, and an applied voltage of 1000 V.

Moreover, the respective volume resistivities in the low-temperature and low-humidity conditions under which the measurement conditions of the temperature and humidity are changed to a temperature of 10° C. and a humidity of 15 RH % and in the high-temperature and high-humidity conditions under which the measurement conditions are changed to a temperature of 28° C. and a humidity of 85 RH % are measured on the basis of the aforementioned method. The results are shown in the following Table 2.

In addition, the "volume resistivity $\rho^\alpha$(out] of the outer layer in a state where load is applied from above the outer layer so that the thickness of the inner layer may become at least any thickness of from 20% to 30% of the thickness when no load is applied is calculated using the measurement value of the aforementioned "volume resistivity [$\rho^0$(out)] of the outer layer in a state where no load is applied" because the inner layer plays a role of a dent of the nip N portion as already described.

(Image Quality Evaluation Test)

In an alternating apparatus (one alternated so that the degree of pressing may be set for formation of a nip) of the image forming apparatus: Docu Centre-II C6500 made by Fuji Xerox Co. Ltd., the transfer roll is used as a primary transfer roll, and the loading condition at the nip is set so that the thickness of the inner layer may become the thickness described in the "inner layer thickness at the nip (at the time of load)" of the following Table 2.

This image forming apparatus is used to form images in an environment of a temperature of 22° C. and a humidity of 55 RH %, at the low temperature and low humidity of a temperature of 10° C. and a humidity of 15 RH %, and a high temperature and high humidity of a temperature of 28° C. and a humidity of 85 RH %, the reproducibility of thin lines and dot reproducibility are organoleptically evaluated by 50 times magnification observation, and evaluated according to following evaluation criteria.

In addition, evaluation is performed on images that are irradiated by an LED and stressed after development and before fixing so that the test may give stress.

A: Toner scattering is not found

B: Shape is slightly disordered

C: Outline is not clear due to scattering

D: There is scattering such that outline may not be recognized

Examples 2 to 4

First, transfer rolls are obtained by the same method as Example 1.

Next, the physical property values are measured by the method described in Example 1 and an image quality evaluation test is performed, except that the loading conditions (the thickness of the inner layer) in the measurement of the volume resistivity [$\rho^\alpha$(in)] of the inner layer in a state where load is applied, and the loading conditions (the thickness of the inner layer) at the nip in the image forming apparatus in an image quality evaluation test are changed so as to become the "inner layer thickness at the nip (at the time of load)" described in the following Table 2.

The results are shown in Table 2.

Examples 5 to 8 and Comparative Examples 1 and 2

The physical property values are measured by the method described in Example 2 and an image quality evaluation test is performed, except that the combinations of the inner layer and outer layer in the transfer rolls are changed as shown in the table 1.

The results are shown in Table 3.

TABLE 2

| | | Examples | | | |
|---|---|---|---|---|---|
| | | 1 | 2 | 3 | 4 |
| Asker-C Hardness of Outer Layer | | 40 | 40 | 40 | 40 |
| Asker-C Hardness of Inner Layer | | 15 | 15 | 15 | 15 |
| Resistivity of Outer Layer with no load | 22° C. 55% | 7.0 | 7.0 | 7.0 | 7.0 |
| [$\rho^0$ (OUT)] | 10° C. 15% | 7.4 | 7.4 | 7.4 | 7.4 |
| | 28° C. 85% | 6.4 | 6.4 | 6.4 | 6.4 |
| Resistivity of Inner Layer with no load | 22° C. 55% | 7.5 | 7.5 | 7.5 | 7.5 |
| [$\rho^0$ (IN)] | 10° C. 15% | 7.5 | 7.5 | 7.5 | 7.5 |
| | 28° C. 85% | 7.5 | 7.5 | 7.5 | 7.5 |

TABLE 2-continued

| | | Examples | | | |
|---|---|---|---|---|---|
| | | 1 | 2 | 3 | 4 |
| Resistivity of Inner Layer at Load | 22° C. 55% | 6.2 | 6.4 | 6.6 | 6.8 |
| [$\rho^{\alpha}$ (IN)] | 10° C. 15% | 6.2 | 6.4 | 6.6 | 6.8 |
| | 28° C. 85% | 6.2 | 6.4 | 6.6 | 6.8 |
| Total Resistivity at Load | 22° C. 55% | 7.0 | 7.0 | 7.0 | 7.1 |
| | 10° C. 15% | 7.4 | 7.4 | 7.4 | 7.4 |
| | 28° C. 85% | 6.4 | 6.4 | 6.6 | 6.9 |
| Thickness of Inner Layer in Regions Other Than Nip (with no load) | | 10 mm | 10 mm | 10 mm | 10 mm |
| Thickness of Inner Layer at Nip (at Load) | | 2 mm | 3 mm | 4 mm | 5 mm |
| Thickness of Inner Layer at Load/Thickness of Inner Layer with no load | | 20% | 30% | 40% | 50% |
| (1) Difference in Resistivity between | 22° C. 55% | 0.5 | 0.5 | 0.5 | 0.5 |
| Inner Layer and Outer Layer with no load | 10° C. 15% | 0.1 | 0.1 | 0.1 | 0.1 |
| [Inner Layer − Outer Layer] | 28° C. 85% | 1.1 | 1.1 | 1.1 | 1.1 |
| (2) Difference in Resistivity between | 22° C. 55% | −0.8 | −0.6 | −0.4 | −0.2 |
| Inner Layer and Outer Layer at Load | 10° C. 15% | −1.2 | −1.0 | −0.8 | −0.6 |
| [Inner Layer − Outer Layer] | 28° C. 85% | −0.2 | 0.0 | 0.2 | 0.4 |
| Image Quality Evaluation | 22° C. 55% | A | B | B | C |
| | 10° C. 15% | A | A | A | B |
| | 28° C. 85% | C | C | D | D |

TABLE 3

| | | Examples | | | | Comparative Example | |
|---|---|---|---|---|---|---|---|
| | | 5 | 6 | 7 | 8 | 1 | 2 |
| Asker-C Hardness of Outer Layer | | 40 | 40 | 32 | 43 | 25 | 48 |
| Asker-C Hardness of Inner Layer | | 7 | 20 | 15 | 15 | 15 | 15 |
| Resistivity of Outer Layer with | 22° C. 55% | 7.0 | 7.0 | 7.1 | 6.9 | 6.9 | 7.4 |
| no load | 10° C. 15% | 7.4 | 7.4 | 7.5 | 7.3 | 7.2 | 7.7 |
| [$\rho^{0}$ (OUT)] | 28° C. 85% | 6.4 | 6.4 | 6.5 | 6.3 | 6.3 | 6.8 |
| Resistivity of Inner Layer with | 22° C. 55% | 7.5 | 7.5 | 7.5 | 7.5 | 7.5 | 7.5 |
| no load | 10° C. 15% | 7.5 | 7.5 | 7.5 | 7.5 | 7.5 | 7.5 |
| [$\rho^{0}$ (IN)] | 28° C. 85% | 7.5 | 7.5 | 7.5 | 7.5 | 7.5 | 7.5 |
| Resistivity of Inner Layer at | 22° C. 55% | 6.8 | 6.4 | 6.6 | 6.2 | 6.8 | 6.4 |
| Load | 10° C. 15% | 6.8 | 6.4 | 6.6 | 6.2 | 6.8 | 6.4 |
| [$\rho^{\alpha}$ (IN)] | 28° C. 85% | 6.8 | 6.4 | 6.6 | 6.2 | 6.8 | 6.4 |
| Total Resistivity at Load | 22° C. 55% | 7.3 | 7.5 | 7.1 | 6.9 | 6.9 | 7.4 |
| | 10° C. 15% | 7.4 | 7.5 | 7.5 | 7.3 | 7.2 | 7.7 |
| | 28° C. 85% | 7.3 | 7.5 | 6.5 | 6.3 | 6.8 | 6.7 |
| Thickness of Inner Layer in Regions Other Than Nip (with no load) | | 10 mm | 10 mm | 10 mm | 10 mm | 10 mm | 10 mm |
| Thickness of inner Layer at Nip (at Load) | | 3 mm | 3 mm | 3 mm | 3 mm | 3 mm | 3 mm |
| Thickness of Inner Layer at Load/Thickness of Inner Layer with no load | | 30% | 30% | 30% | 30% | 30% | 30% |
| (1) Difference in Resistivity | 22° C. 55% | 0.5 | 0.5 | 0.4 | 0.6 | 0.6 | 0.1 |
| between Inner Layer and Outer | 10° C. 15% | 0.1 | 0.1 | 0.0 | 0.2 | 0.3 | −0.2 |
| Layer with no load | 28° C. 85% | 1.1 | 1.1 | 1.0 | 1.2 | 1.2 | 0.7 |
| [Inner Layer − Outer Layer] | | | | | | | |
| (2) Difference in Resistivity | 22° C. 55% | −0.2 | −0.6 | −0.5 | −0.7 | −0.1 | −1.0 |
| between Inner Layer and Outer | 10° C. 15% | −0.6 | −1.0 | −0.9 | −1.1 | −0.4 | −1.3 |
| Layer at Load | 28° C. 85% | 0.4 | 0.0 | 0.1 | −0.1 | 0.5 | −0.4 |
| [Inner Layer − Outer Layer] | | | | | | | |
| Image Quality Evaluation | 22° C. 55% | C | B | B | A | C | Poor Transfer |
| | 10° C. 15% | B | A | A | A | C | Poor Transfer |
| | 28° C. 85% | D | C | C | C | D | C |

In Comparative Example 2, as shown in Table 3, image quality evaluation may not be performed because poor transfer occurs.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer roll comprising:

a cylindrical conductive substrate;

an inner elastic layer having an Asker-C hardness of from 5° to 20°; and an outer elastic layer having an Asker-C hardness of from 30° to 45° in this order, wherein the transfer roll satisfies the following Expression (1):

$$\rho^{0}(in)>\rho^{0}(out) \quad \text{Expression (1):}$$

wherein $\rho^{0}(in)$ is a volume resistivity of the inner elastic layer that is measured by applying an applied voltage of 1000 V in an environment of a temperature of 22° C. and a humidity of 55 RH % in an unloaded state, and $\rho^{0}(out)$ is a volume resistivity of the outer elastic layer that is measured by applying an applied voltage of 1000 V in an environment of a temperature of 22° C. and a humidity of 55 RH % in an unloaded state.

2. The transfer roll according to claim 1, wherein the transfer roll satisfies following Expression (2):

$$\rho^{\alpha}(in)<\rho^{\alpha}(out) \quad \text{Expression (2):}$$

wherein $\rho^{\alpha}(in)$ is a volume resistivity of the inner elastic layer that is measured by applying an applied voltage of 1000 V in an environment of a temperature of 22° C. and a humidity of 55 RH % in a state where load is applied from above the outer elastic layer so that the thickness of the inner elastic layer may become at least any thickness of from 20% to 30% of the thickness in an unloaded state, and $\rho^{\alpha}(out)$ is a volume resistivity of the outer elastic layer that is measured by applying an applied voltage of 1000 V in an environment of a temperature of 22° C. and a humidity of 55 RH % in a state where load is applied from above the outer elastic layer so that the thickness of the inner elastic layer may become the thickness of 30% of the thickness in an unloaded state.

3. The transfer roll according to claim 1, wherein the inner elastic layer contains a conductive material with electron conductivity and the outer elastic layer contains a conductive material with ion conductivity.

4. The transfer roll according to claim 2, wherein the inner elastic layer contains a conductive material with electron conductivity and the outer elastic layer contains a conductive material with ion conductivity.

5. The transfer roll according to claim 1, wherein the thickness of the inner elastic layer is within a range of from 1 mm to 10 mm and the thickness of the outer elastic layer is within a range of from 1 mm to 10 mm.

6. The transfer roll according to claim 1, wherein the inner elastic layer is an elastic layer having bubbles.

7. The transfer roll according to claim 1, wherein the outer elastic layer is an elastic layer having bubbles.

8. The transfer roll according to claim 6, wherein the average bubble diameter of the inner elastic layer is smaller than the average bubble diameter of the outer elastic layer.

9. The transfer roll according to claim 6, wherein the average bubble diameter of the inner elastic layer is from 100 μm to 300 μm.

10. The transfer roll according to claim 7, wherein the average bubble diameter of the outer elastic layer is from 150 μm to 400 μm.

11. An image forming apparatus comprising:

an image holding member;

a latent image forming device that forms an electrostatic latent image on the surface of the image holding member;

a developing device that develops the electrostatic latent image with a toner to form a toner image;

an intermediate transfer belt;

a primary transfer device that is arranged so as to face the image holding member via the intermediate transfer belt and form a nip by a load applied from the image holding member, and applies a voltage for transferring the toner image on the image holding member to the surface of the intermediate transfer belt; and a secondary transfer device that transfers the toner image transferred to the intermediate transfer belt to a recording medium, wherein the primary transfer device includes the transfer roll according to claim 1.

12. The image forming apparatus according to claim 11, comprising a primary transfer device in which the transfer roll satisfies the following Expression (3-1):

$$\rho^{\beta-1}(in)<\rho^{\beta-1}(out) \quad \text{Expression (3-1):}$$

wherein $\rho^{\beta-1}(in)$ is a volume resistivity of the inner elastic layer at the voltage in a state where the nip is formed, and $\rho^{\beta-1}(out)$ is a volume resistivity of the outer elastic layer in a state where the nip is formed.

13. An image forming apparatus comprising:

an image holding member;

a latent image forming device that forms an electrostatic latent image on the surface of the image holding member;

a developing device that develops the electrostatic latent image with a toner to form a toner image;

an intermediate transfer belt;

a primary transfer device that transfers the toner image on the image holding member to the surface of the intermediate transfer belt; and a secondary transfer device including a secondary transfer roll contacting the outer peripheral surface side of the intermediate transfer belt and having a recording medium inserted between the secondary transfer roll and the intermediate transfer belt, and a facing roll arranged so as to face the secondary transfer roll via the intermediate transfer belt and form a nip by a load applied from the secondary transfer roll, and applying a voltage for transferring the toner image on the intermediate transfer belt to a recording medium, wherein the facing roll is the transfer roll according to claim 1.

14. The image forming apparatus according to claim 13, comprising a secondary transfer device in which the facing roll satisfies the following Expression (3-2):

$$\rho^{\beta-2}(in)<\rho^{\beta-2}(out) \quad \text{Expression (3-2):}$$

wherein $\rho^{\beta-2}(in)$ is a volume resistivity of the inner elastic layer at the voltage in a state where the nip is formed, and $\rho^{\beta-2}(out)$ is a volume resistivity of the outer elastic layer in a state where the nip is formed.

15. An image forming apparatus comprising:

an image holding member;

a latent image forming device that forms an electrostatic latent image on the surface of the image holding member;

a developing device that develops the electrostatic latent image with a toner to form a toner image;

an intermediate transfer belt;

a primary transfer device that transfers the toner image on the image holding member to the surface of the intermediate transfer belt; and a secondary transfer device including a secondary transfer roll contacting the outer peripheral surface side of the intermediate transfer belt and having a recording medium inserted between the secondary transfer roll and the intermediate transfer belt, and a facing roll arranged so as to face the secondary transfer roll via the intermediate transfer belt and form a nip by applying a load to the secondary transfer roll, and applying a voltage for transferring the toner image on the intermediate transfer belt to a recording medium, wherein the secondary transfer roll is the transfer roll according to claim 1.

16. The image forming apparatus according to claim 15, comprising a secondary transfer device in which the secondary transfer roll satisfies the following Expression (3-3):

$$\rho^{\beta-3}(in)<\rho^{\beta-3}(out) \quad \text{Expression (3-3):}$$

wherein $\rho^{\beta-3}(in)$ is a volume resistivity of the inner elastic layer at the voltage in a state where the nip is formed, and $\rho^{\beta-3}(out)$ is a volume resistivity of the outer elastic layer in a state where the nip is formed.

* * * * *